US007712462B2

(12) United States Patent
Pedicini et al.

(10) Patent No.: US 7,712,462 B2
(45) Date of Patent: May 11, 2010

(54) PORTABLE ELECTRIC-DRIVEN COMPRESSED AIR GUN

(75) Inventors: Christopher Pedicini, Nashville, TN (US); John Witzigreuter, Kennesaw, GA (US)

(73) Assignee: Impulse Solutions, LLC, Flagstaff, AZ (US)

( * ) Notice: Subject to any disclaimer, the term of this patent is extended or adjusted under 35 U.S.C. 154(b) by 744 days.

(21) Appl. No.: 11/052,542

(22) Filed: Feb. 7, 2005

(65) Prior Publication Data

US 2005/0235975 A1 Oct. 27, 2005

Related U.S. Application Data

(63) Continuation-in-part of application No. 10/764,793, filed on Jan. 26, 2004, now Pat. No. 6,857,422.

(60) Provisional application No. 60/477,591, filed on Jun. 12, 2003, provisional application No. 60/517,069, filed on Nov. 5, 2003.

(51) Int. Cl.
*F41B 11/12* (2006.01)

(52) U.S. Cl. ..... 124/65

(58) Field of Classification Search ..... 124/71–77, 124/63–68, 70
See application file for complete search history.

(56) References Cited

U.S. PATENT DOCUMENTS

| | | | | | |
|---|---|---|---|---|---|
| 1,343,127 | A | | 6/1920 | Hallinan | |
| 1,375,653 | A | | 4/1921 | McLain et al. | |
| 1,405,012 | A | * | 1/1922 | Schneider | 124/67 |
| 1,447,458 | A | | 3/1923 | Zint | |
| 1,743,576 | A | | 1/1930 | Smith | |
| 1,830,763 | A | | 11/1931 | Loomis | |
| 1,860,611 | A | | 5/1932 | Minno et al. | |
| 2,116,860 | A | * | 5/1938 | Blaylock et al. | 89/1.4 |
| 2,170,221 | A | | 8/1939 | Stanley | |
| 2,331,163 | A | * | 10/1943 | Benjamin | 124/69 |
| 2,391,636 | A | * | 12/1945 | McArthur | 89/1.1 |
| 2,550,887 | A | | 5/1951 | Tratsch | |
| 2,568,432 | A | | 9/1951 | Cook | |
| 2,604,088 | A | * | 7/1952 | Wells | 124/67 |
| 2,834,332 | A | | 5/1958 | Guthrie | |

(Continued)

FOREIGN PATENT DOCUMENTS

| | | |
|---|---|---|
| DE | 40 40 456 A1 | 6/1992 |

(Continued)

*Primary Examiner*—Troy Chambers
(74) *Attorney, Agent, or Firm*—Jay Schloff

(57) ABSTRACT

A portable motor driven air gun powered by a power source includes a motor that is coupled to a pinion which drives a rack connected to a piston. The piston compresses air in a chamber producing high-pressure air. When sufficient energy is stored within the air stream by the piston, a valve opens which releases the compressed air to push a projectile through a barrel. The pinion rotates until it comes to an interrupted thread surface, at which point the rack and pinion are returned to the starting position via a spring. The piston may be coupled to a bolt thru a lost motion device to facilitate positioning of the projectile for firing. The direction speed and operative modes of the gun may be controlled with an electric circuit. The power source may be rechargeable, allowing the air gun to be operated independent from either a wall outlet or a compressed air supply.

17 Claims, 5 Drawing Sheets

U.S. PATENT DOCUMENTS 2,837,076 A 6/1958 Koci et al.
3,111,121 A * 11/1963 Baggott ..... 124/67
3,128,753 A 4/1964 Politzer
3,212,490 A 10/1965 Merz
3,302,319 A * 2/1967 Rosselet ..... 42/106
3,523,538 A 8/1970 Shimizu
3,838,676 A * 10/1974 Kahelin ..... 124/75
3,915,143 A * 10/1975 Waller ..... 124/77
3,951,038 A * 4/1976 Van Langenhoven ..... 89/7
4,137,893 A 2/1979 Beauchamp
4,694,815 A 9/1987 Hung
4,870,945 A 10/1989 Hutchison
4,899,717 A 2/1990 Rutten et al.
5,129,383 A 7/1992 Rutten
5,154,157 A * 10/1992 Goepfert ..... 124/69
5,261,384 A 11/1993 Hu
5,363,834 A * 11/1994 Stuchlik ..... 124/76
5,381,928 A * 1/1995 Lee et al. ..... 222/79
5,503,137 A * 4/1996 Fusco ..... 124/72
5,531,210 A * 7/1996 Meiser et al. ..... 124/66
5,727,538 A 3/1998 Ellis
5,771,621 A * 6/1998 Rogers ..... 42/55
6,026,798 A * 2/2000 Sanders et al. ..... 124/78
6,142,137 A 11/2000 MacLaughlin
6,250,294 B1 6/2001 Lim
6,279,562 B1 * 8/2001 Clayton ..... 124/59
6,311,682 B1 * 11/2001 Rice et al. ..... 124/71
6,439,216 B1 * 8/2002 Johnson et al. ..... 124/70
6,474,326 B1 11/2002 Smith et al.
6,516,791 B2 2/2003 Perrone
6,532,949 B1 3/2003 McKendrick
6,564,788 B1 * 5/2003 Hu ..... 124/66
6,807,959 B1 * 10/2004 Murdock et al. ..... 124/61
6,832,604 B1 * 12/2004 Thompson ..... 124/75
6,857,422 B2 * 2/2005 Pedicini et al. ..... 124/63
6,957,645 B1 * 10/2005 Cross ..... 124/51.1
2003/0098019 A1 * 5/2003 Hu ..... 124/66
2004/0144377 A1 * 7/2004 Dobbins ..... 124/74
2005/0000505 A1 * 1/2005 Pedicini et al. ..... 124/63
2005/0188974 A1 * 9/2005 Pedicini et al. ..... 124/65
2005/0188975 A1 * 9/2005 Rice et al. ..... 124/71
2005/0235975 A1 * 10/2005 Pedicini et al. ..... 124/67

FOREIGN PATENT DOCUMENTS

DE 42 12 623 A1 10/1993
FR 2 681 674 A 3/1993

* cited by examiner

PORTABLE ELECTRIC-DRIVEN COMPRESSED AIR GUN

CROSS-REFERENCE TO RELATED APPLICATIONS

This utility application is the Continuation-In-Part application of the nonprovisional utility U.S. patent application Ser. No. 10/764,793 filed on Jan. 26, 2004 now U.S. Pat. No. 6,857,422, which claims benefit from is the nonprovisional application of U.S. Provisional Application Nos. 60/477,591 filed on Jun. 12, 2003 and 60/517,069 filed on Nov. 5, 2003, each of which are herein incorporated by reference in their entirety.

BACKGROUND OF INVENTION

This invention relates to pneumatic guns, air rifles, pellet rifles, paintball guns and the like. Such pneumatic guns are typically driven by either hand cocked springs, compressed gas, or hand operated pumps. The disadvantages of these guns are outlined in more detail below.

Air rifles have been around for many years and have seen numerous evolutionary changes over the years. The most common methods for propelling the projectile use the energy from compressed gas or from a spring. There are four major techniques shown in the prior art for launching the projectile with many variations based upon such teachings. These techniques include: (i) the use of stored compressed gas in the form of carbon dioxide cylinders or other high pressure storage tanks; (ii) using a powerful spring to push a piston which compresses air which then pushes the projectile; (iii) using a hand pump to pressurize the air for subsequent release; and (iv) using a direct acting means such as a solenoid plunger or centrifugal force to push the projectile out of the barrel. All of these methods have distinct disadvantages when compared to the present invention.

The first technique requires a source of compressed air, such as a tank or canister. Filling, transporting and using such a canister represents a significant inconvenience and burden for the user. Often, additional equipment such as regulators, evaporation chambers, multistage regulators and complicated timing circuits are required to reduce and control the very high pressure in the cylinder to a level suitable for launching the projectile. This further increases the cost and complexity of such an air gun. Additionally, in the case of carbon dioxide driven air or paintball guns, there is a large variation in the velocity of the projectile with varying ambient temperatures. Furthermore, these tanks store an incredible amount of energy which, if released suddenly through a tank fault, could represent a significant safety factor. Disposable cartridges, which can be used in less costly air guns, significantly increase refuse issues. Additional teachings such as those contained in U.S. Pat. Nos. 6,516,791, 6,474,326, 5,727,538 and 6,532,949 teach of various ways of porting and controlling high pressure air supplies to improve the reliability of air guns (specifically paintball guns and the like) by differentiating between the airstream which is delivered to the bolt which facilitates chambering the projectile and the airstream which pushes the projectile out of the barrel. All of these patents still suffer from the major inconvenience and potential safety hazard of storing a large volume of highly compressed gas within the air gun. Additionally, as they combine electronic control with the propulsion method of stored compressed gas, the inherent complexity of the mechanism increases, thus, increasing cost and reliability issues. Further, U.S. Pat. No. 6,142,137 teaches about using electrical means to assist in the trigger control of a compressed air gun such as a paintball gun. In this patent, an electromotive device is used in conjunction with electronics to define various modes of fire control such as single shot, burst or automatic modes. While this addresses the ability of multiple modes of fire, it does not solve the fundamental propulsion problem associated with gas cylinders and, in addition, it is expensive and complicated.

The second technique is actually quite simple and has been used for quite a few years in many different types of pellet, "bb" or air rifles. The basic principle is to store energy in a spring which is later released to rapidly compress air. This air then pushes the projectile out of the barrel at high velocity. Problems with this method include the need to "cock" the spring between shots. Thus, it is only suitable for single shot devices and is limited to very slow rates of fire. Furthermore, the spring results in a double recoil effect when it is released. The first recoil is due to the unwinding of the spring and the second recoil is due to the spring slamming the piston into the end of the cylinder (i.e. forward recoil). Additionally, the spring air rifles require a significant amount of maintenance and, if dry-fired, the mechanism can be damaged. Finally, the effort required for such "cocking" is often substantial and can be difficult for many individuals. References to these style air guns can be found in U.S. Pat. Nos. 3,128,753, 3,212,490, 3,523,538, and 1,830,763. Additional variations on the above technique have been attempted through the years including using an electric motor to cock the spring that drives a piston. This variation is detailed in U.S. Pat. Nos. 4,899,717 and 5,129,383. While this innovation solves the problem of cocking effort, the resulting air rifle still suffers from a complicated mechanism, double recoil and maintenance issues associated with the spring piston system. Another mechanism which uses a motor to wind a spring is shown in U.S. Pat. No. 5,261,384. Again, the use of indirect means to store the electrical energy in a spring before release to the piston to push the projectile results in an inefficient and complicated assembly. Furthermore, the springs in such systems are highly stressed mechanical elements that are prone to breakage and which increase the weight of the air gun. A similar reference can be seen in U.S. Pat. No. 1,447,458 which shows a spring winding and then delivery to a piston to compress air and propel a projectile. In this case, the device is for non-portable operation.

The third technique, using a hand pump to pressurize the air, is often used on low end devices and suffers from the need to pump the air gun between 2 to 10 times to build up enough air supply for sufficient projectile velocity. This again limits the air rifle or paintball gun to slow rates of fire. Additionally, because of the delay between when the air is compressed and when the compressed air is released to the projectile, variations in the energy are quite common for a standard number of pumps. Further taught in U.S. Pat. Nos. 2,568,432 and 2,834,332 is a method to use a solenoid to directly move a piston which compresses air and forces the projectile out of the air rifle. While this solves the obvious problem of manually pumping a chamber up in order to fire a gun, these devices suffer from the inability to store sufficient energy in the air stream. Solenoids are inefficient devices and can only convert very limited amounts of energy due to their operation. Furthermore, since the air stream is coupled directly to the projectile in this technique, the projectile begins to move as the air is being compressed. This limits the ability of the solenoid to store energy in the air stream to a very short time period and further relegates its use to low energy air rifles. In order to improve the design, the piston must actuate in an extremely fast time frame in order to prevent significant projectile movement during the compression stroke. This results in a very energetic piston mass similar to that shown in spring piston designs and further results in the undesirable double recoil effect as the piston mass must come to a halt. Additionally, this technique suffers from dry-fire in that the air is compressed between the piston and the projectile. A missing projectile allows the air to communicate to the atmosphere through the barrel and can damage the mechanism in a dry-fire scenario. Another variant of this approach is disclosed in U.S. Pat. No. 1,375,653, which uses an internal combustion engine instead of a solenoid to act against the piston. Although this solves the issue of sufficient power, it is no longer considered an air rifle as it becomes a combustion driven gun. Moreover, it suffers from the aforementioned disadvantages including complexity and difficulty in controlling the firing sequence. Further taught in U.S. Pat. No. 4,137,893 is the use of an air compressor coupled to a storage tank which is then coupled to the air gun. Although this solves the issue of double recoil, it is not suitable to a portable system due to inefficiencies of compressing air and the large tank volume required. When air is used in this fashion, it compresses via adiabatic means, but the heat of compression is dissipated due to the large volume of air and the subsequent storage in a tank. In order to overcome the variation in air pressure, further expense and complexity in terms of valving and regulators must be added. A variation of the above is to use a direct air compressor as shown in U.S. Pat. No. 1,743,576. Again, due to the large volume of air between the compression means and the projectile, much of the heat of compression is lost leading to a very inefficient operation. Additionally, this patent teaches of a continuously operating device which suffers from a significant lock time (time between trigger pull and projectile leaving the barrel) as well as the inability to run in a semiautomatic or single shot mode. Further disadvantages of this device include the pulsating characteristics of the air stream which are caused by the release and reseating of the check valve during normal operation.

The fourth technique is to use direct mechanical action on the projectile itself. The teachings in U.S. Pat. Nos. 1,343,127 and 2,550,887 represent such mechanisms. Limitations of this approach include difficulty in achieving high projectile velocity since the transfer of energy must be done extremely rapidly between the impacting hammer and the projectile. Additionally, this method suffers from the need to absorb a significant impact as the solenoid plunger must stop and return for the next projectile. This can cause a double-recoil firing characteristic. Since the solenoid plunger represents a significant fraction of the moving mass (i.e. it often exceeds the projectile weight) this type of system is very inefficient and limited to low velocity, low energy air guns as may be found in toys and the like. Variations of this method include those disclosed in U.S. Pat. No. 4,694,815 in which a hammer driven by a spring contacts the projectile. The spring is "cocked" via an electric motor, but again, this does not overcome the prior mentioned limitations.

All of the currently available devices suffer from a number of disadvantages, some of which include:

1. Difficult operation. Cocking or pumping air rifles can be time consuming and a physical chore.
2. Inability to rapidly move between single fire, semiautomatic, burst or automatic modes. Inability to support rapid-fire operation required by the above.
3. Significant inconvenience in the refilling transport and use of high-pressure gas cylinders.
4. Non-portability. Traditional air rifles at carnivals and the like are tethered to a compressed air supply or due to inefficient compressor operation require a large power source such as a wall outlet.
5. Double recoil effects.
6. Complicated mechanisms and air porting schemes leading to potentially expensive production costs and reliability issues.
7. Inefficient usage and/or coupling of the compressed air to the projectile resulting in low energy projectiles and large energy input requirements.

BRIEF SUMMARY OF THE INVENTION

In accordance with the present invention, a piston is driven by a rack and pinion mechanism or other linear motion converter, to compress air within a cylinder. When the desired pressure or stroke is reached a valve is opened, or is allowed to open, releasing the high-pressure air toward a projectile and launching the projectile. An electric motor, which derives its power from a low impedance electrical source, such as rechargeable batteries, is coupled, to the rack via a pinion creating a very simple and robust design. The coupling mechanism includes provisions to decouple the motor from the rack at a point in the cycle. Additionally, the piston and rack assembly is coupled to a bolt in order to force the bolt to move in cooperation with the movement of the piston. This coupling includes springs and sliding members to reduce the travel of the bolt to fractional percentage of the overall piston movement. This increases the overall safety and reduces the wear of the mechanism.

Accordingly, besides the objects and advantages of the portable electric air gun as described, several objects and advantages of the present invention are:

1. To provide an electric motor driven gun in which the operating element has an added degree of safety in that the energy is on demand and not stored in high pressure cylinders.
2. To provide a means in which the operation is portable eliminating any tethering of hoses or cords.
3. To provide a means in which the operation uses relatively low pressure air thus reducing the sound profile and allowing for stealth operation.
4. To provide a means in which the control of the projectile is enabled by electronic means thus increasing the safety profile and speed control.
5. To provide an electric motor driven gun in which the source of energy is a rechargeable power supply thus eliminating the use of disposable or refillable gas pressure cylinders and decreasing overall operational cost.
6. To provide an electric motor driven gun which is mechanically simpler to construct and simpler to operate.
7. To provide a means for reducing the lock time in a fire on demand electric motor driven air gun.
8. To provide a means in which the feed mechanism for the projectiles is controlled by the electric motor thus allowing for a simple design which does not rob energy from the air stream.
9. To provide a means in which the compression is more efficiently utilized by reducing the delay between compression and firing, thus, accessing a large part of the heat energy of compression.
10. To provide a design which uses direct air compression and eliminates the spring piston and its associated double recoil.
11. To provide a design in which the energy to return the piston uses a spring or vacuum which is energized on the compression stroke of the piston.

Further objects and advantages will become more apparent from a consideration of the ensuing detailed description and drawings.

BRIEF DESCRIPTION OF THE SEVERAL VIEWS OF THE DRAWINGS

Reference numbers for the drawings are shown below.

REFERENCE NUMBERS IN DRAWINGS

Figure 1:
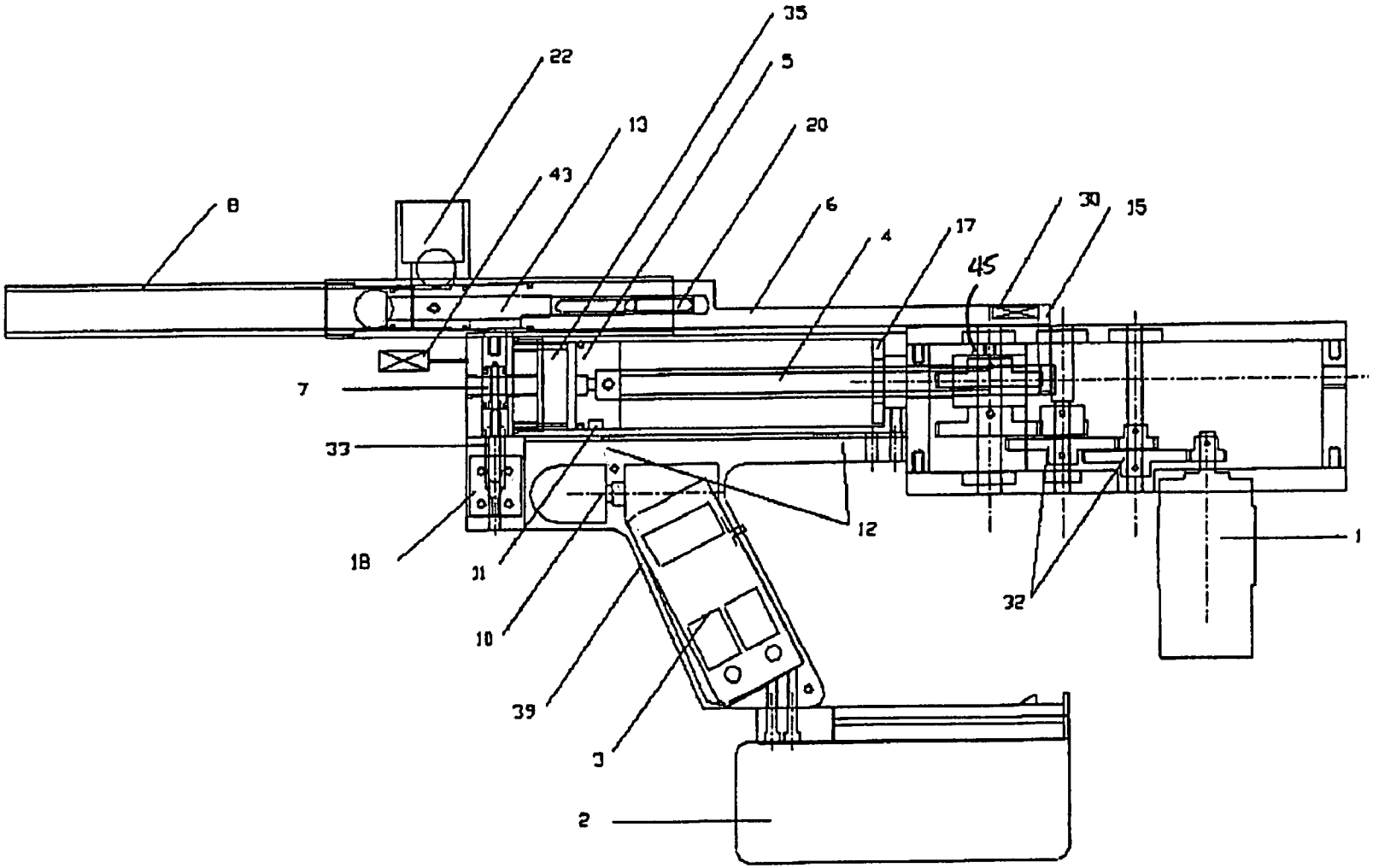
FIG. 1 is a side assembly view of the electric powered air gun in the forward or firing position.

1 Motor
2 Power Source
3 Control Circuit
4 Rack
5 Piston
6 Bolt
7 Valve
8 Barrel
9 Projectile
10 Start Switch
11 Magnet
12 Sensor Switch
13 Compressed Air Passageway
14 Cylinder
15 Bolt Link
16 Projectile Inlet Port
17 Bumper
18 Solenoid
19 Solenoid Detent
20 Bolt Return Spring
21 Forward Air Chamber
22 Projectile Feeder
23 Lost motion coupling
30 Actuation Limit Spring
31 Pinion Gear
32 Drive Train
33 Plunger
34 Bias Spring
35 Piston Return Spring
36 Elastic storage element
37 Retaining mechanism
38 Communication Link
39 Grip
40 Support Bearing
41 Rack Pinion
42 Trigger
43 Check Valve
44 Relief Valve
45 Rack and pinion assembly
46 Gear teeth
47 Section without gear teeth

DETAILED DESCRIPTION OF THE INVENTION

Although the following relates substantially to one embodiment of the design, it will be understood by those familiar with the art that changes to materials, part descriptions and activation methods can be made without departing from the spirit of the invention. Additional designs can be created by combining various described elements. These may have particular advantages depending on the design requirements of the particular electric air gun.

Referring to FIG. 1, the user presses a start switch (10), or trigger that causes power to be directed from the power source (2), to the motor (1) by the control circuit (3). The control circuit is described later but can be as simple as any means for connecting and disconnecting power to the motor (1) to allow an air compression and projectile fire cycle. The motor (1) turns transferring energy through the rotating elements of the system into a linear motion converter and subsequently into the compression of air. The linear motion converter is any means of converting the rotating motion into a linear translation. Examples of linear motion converters include leadscrews with leadnuts, gearbelts with gearbelt pulleys and rack and pinions. The embodiment illustrated in FIG. 1 includes a motor (1), a gear reduction system (32), and a rack and pinion assembly (45) including rack (4) and rack pinion (41). The rack pinion (41) is coupled to the motor (1) through the gear reduction system (32), which comprises one or more stages of gear reduction. The rack (4) is attached to the piston (5), as shown in FIG. 1. The purpose of the gear reduction system (32) is to allow sufficient energy to be transferred from the motor (1) to the air which is being compressed by the piston (5). Other reduction means including, but not limited to, pulleys, gear belts, planetary systems, could be used without departing from the spirit of the invention. In the present embodiment, the piston (5) and the cylinder (14) form the forward air chamber (21). At its initial state before the cycle starts, the forward air chamber (21) has a volume that is greater than 3 $in^3$, with the most desirable starting volume being between 7 $in^3$ and 9 $in^3$. The initial pressure of this starting air is between 0 and 2 atmospheres with the most desirable starting pressure being 1 atmosphere. The piston (5) begins to move forward in cooperation with the rack (4) compressing the air in the forward air chamber (21) while also energizing the piston return spring (35). The piston return spring (35) biases the piston (5) and rack (4) to the initial starting position. Although the return element is shown as a spring in the attached figures, alternative means such as vacuum on the back side of the cylinder (14) could be used as well. The important point is that the return element is energized by the motor (1) during the compression cycle.

Figure 4:
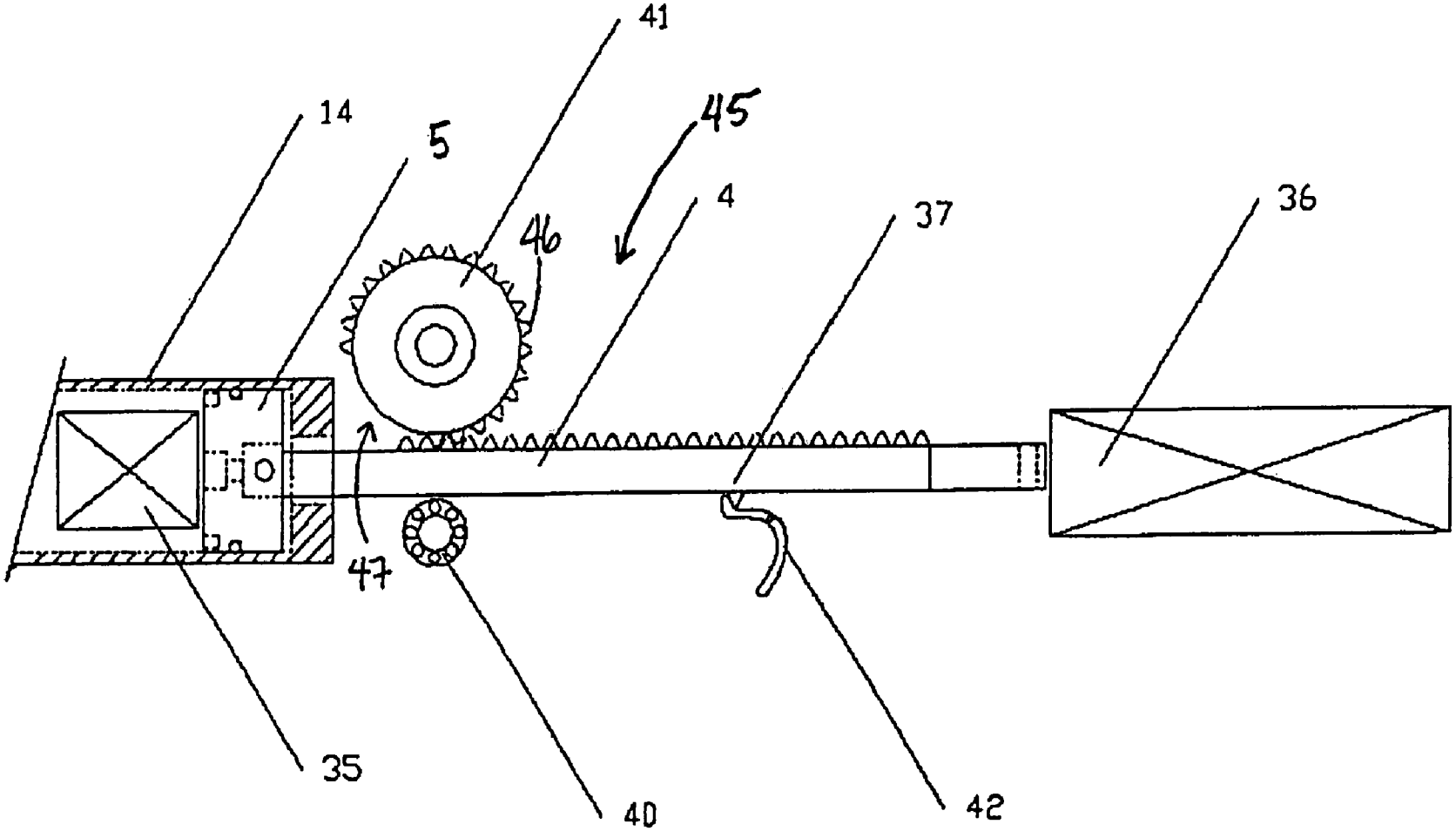
FIG. 4 is a side assembly view of the rack and pinion piston drive assembly used in combination with an elastic storage element and retaining mechanism.

Although the embodiment of FIG. 1 shows the initial position of the piston (5) at the rearward part of the stroke, it is possible to change the starting point such that it corresponds to a small amount of initial compression of the air. A retaining mechanism such as a sear pin to lock the gear and rack (4), could be used to maintain this semienergized state. The purpose of allowing some of the energy to be stored in the air stream would be to reduce the time between when trigger (42) is pulled and shot fired (lock time) on the first shot. This reduction would stem from the fact that some of the firing energy is already stored in the air stream and that the piston (5) would not need to travel as far to complete the stroke. The advantage in reducing the lock time on the first shot is that operator is most likely to notice a delay on the first shot of a sequence but less likely to notice on subsequent shots. The means for retaining the piston (5) in such position could additionally be electrical such as a solenoid detent in addition to mechanical means. Referring to FIG. 4, a substantial lock time improvement of the present invention can be achieved by using an elastic storage means (36), such as a spring, to drive the piston. The energy is stored in the spring then cocked in the rearward position. The spring could be steel, rubber, etc. The motor (1) and linear motion converter drives the piston (5) rearward to store energy in the elastic storage element (36). When the trigger (42) is pulled, the retaining mechanism (37) releases the piston (5) allowing it to be driven forward to compress the air. This releasing of the spring energy and allowing it to compress the air happens quickly giving a more responsive trigger to the player for the first shot. By incorporating a valve (7) in conjunction with this elastic storage means, we can eliminate or greatly minimize the double recoil effect commonly seen in spring piston air guns. This technique of compressing the air against a valve allows us to substantially convert most of the stored energy into energy in the air stream while at the same time controlling the speed at which the piston (5) impacts the end of the cylinder (14). This allows a much gentler impact of the piston (5) on the end of the cylinder (14), thus greatly mitigating the double recoil and associated wear seen in spring piston air guns.

Continuing our discussion of the cycle, as the pinion (41) rotates it drives the rack (4) which moves the piston (5), down the cylinder (14) in the forward direction, storing energy in the air stream. This energy rapidly compresses the air in the forward air chamber (21) in such a way that the compression exponent is polytropic. At the appropriate forward point the compressed air in the forward air chamber (21) is channeled to the projectile (9) through the valve (7). In an efficient design, the time involved in the compression cycle is sufficiently short so as to yield a compression exponent of at least 1.10.

At the end of the compression stroke, the forward air chamber (21) contains high-pressure air that is released to the projectile (9) through the valve (7). The opening of the valve (7) can be by direct mechanical coupling and/or electrical techniques. As is shown in FIG. 1, one embodiment incorporates an electronic solenoid (18) which is controlled in response to timing and/or a sensor such as air pressure, piston location or motor speed. Ideally, the electronics controls the motor such that the valve (7) releases when the motor (1) has slowed to such a point that most of the rotational kinetic energy has been converted to energy in the compressed air. At or near the end of the piston (5) stroke, the valve (7) is caused to shift open. This rapidly releases the compressed air into the compressed air passageway (13) and then into the barrel (8) of the air gun. In order to be effective in an electric marker, it is essential that valve (7) losses be held to a minimum. Two parameters that must be carefully controlled in the valve (7) are pressure drop through the valve (7) and valve opening time.

The projectile (9), which is located within the barrel (8), begins to accelerate under the force of the compressed air and is driven out of the barrel (8) at a high velocity. At this point, the motor (1) may be allowed to continue to rotate driving the rack pinion (41). The rack pinion (41) has a section (47) of the gear in which the teeth (46) have been cutaway. When this section (47) opposes the mating rack (4), there is nothing to retain the rack and pinion assembly (45) in its current position. The piston return spring (35) will then force the rack and piston assembly (45) back to its initial starting position. Decoupling the motor (1) and drive train (32) from the piston (5) and rack (4) allows a rapid return since the piston return spring (35) only needs to position the piston and rack assembly (45). This results in a more efficient system with higher rates of fire. A further advantage of this approach is that the motor (1) can drive in a single direction and crashing the piston (5) into the end of the cylinder (14) can be eliminated by controlling the number of gear teeth (46) in both the rack (4) and rack pinion (41).

Figure 2:
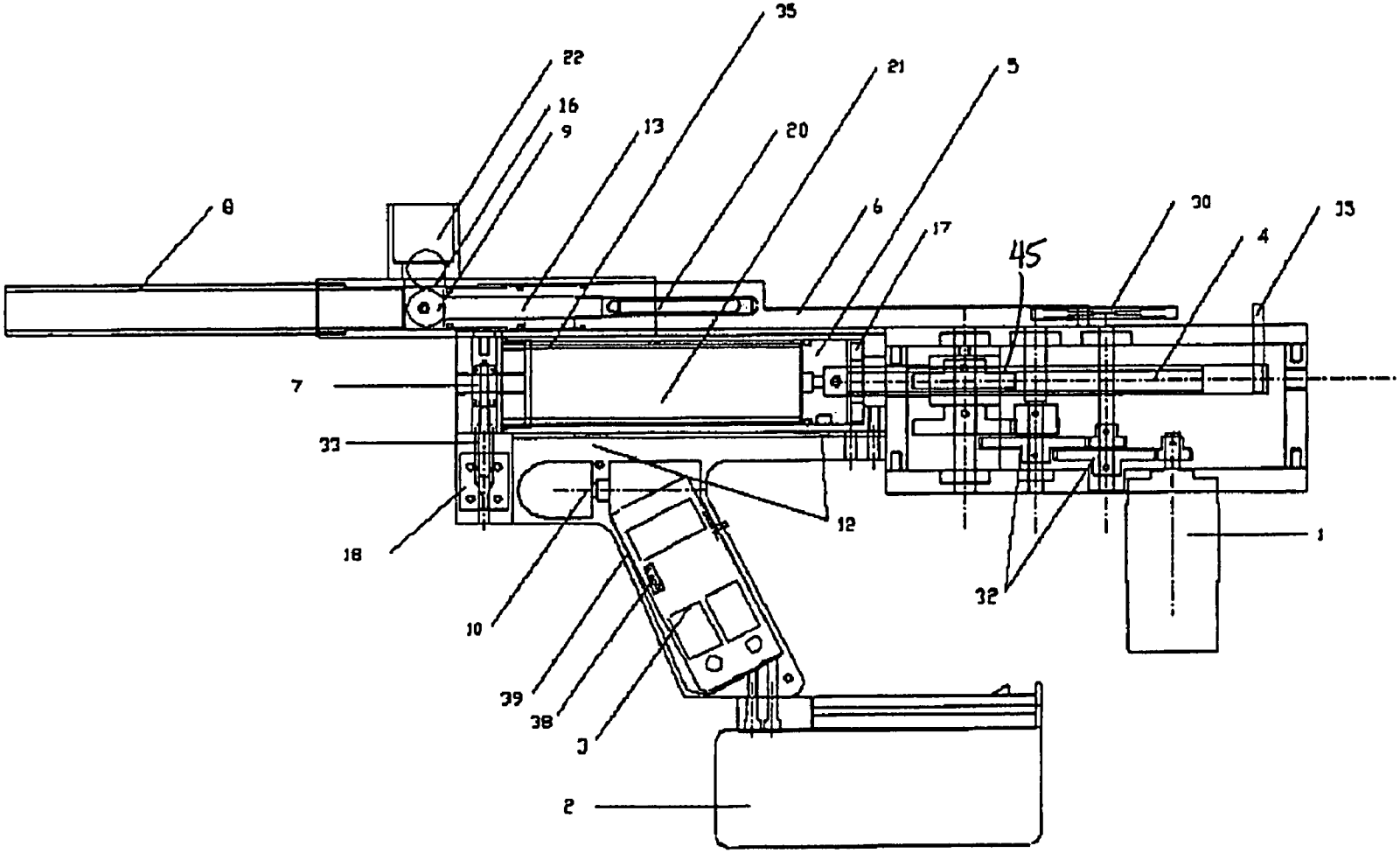
FIG. 2 is a side assembly view of the electric powered air gun in the retracted position.
Figure 3:
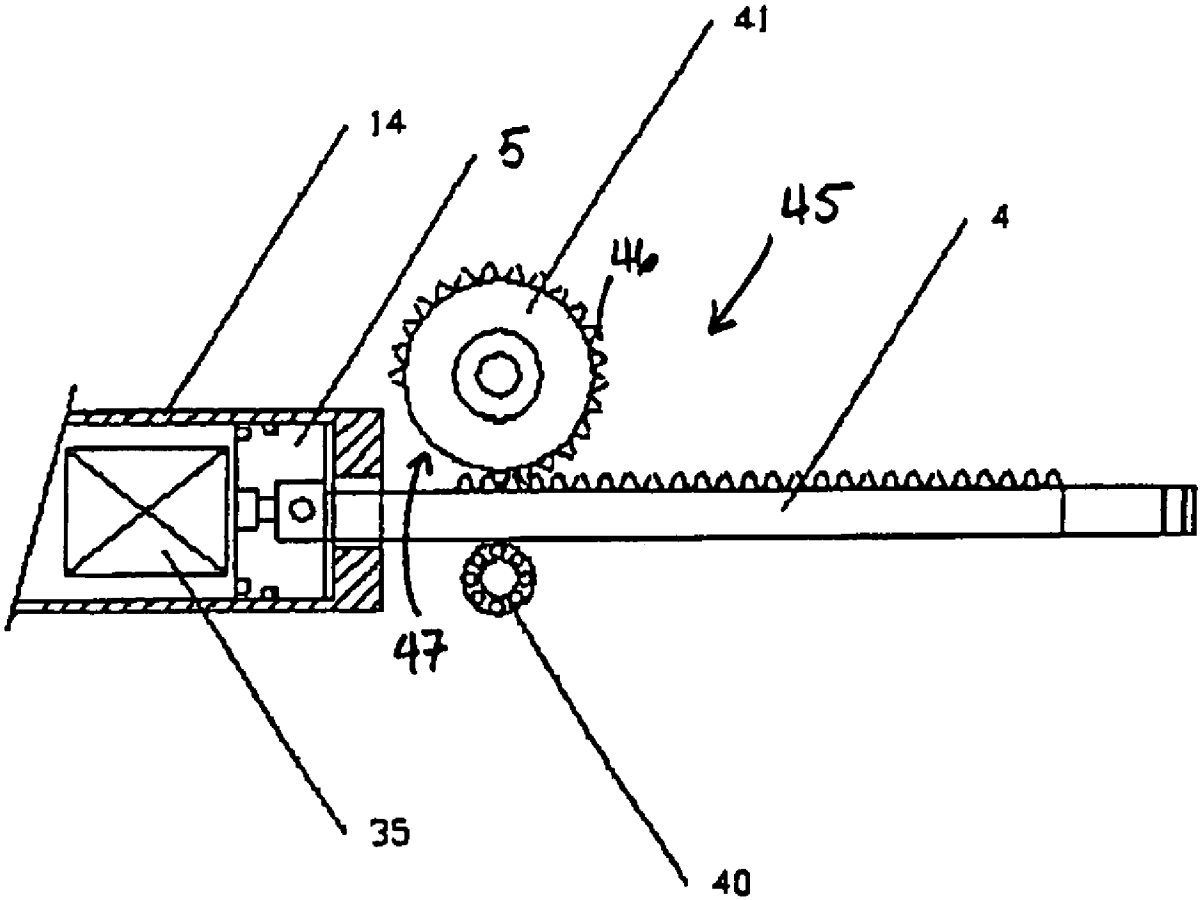
FIG. 3 is a side assembly view of the rack and pinion piston drive assembly.

Looking to FIGS. 1 and 2, a sensor switch (12) recognizes when the piston (5) is in its approximate initial position and ready for cycle initiation. The sensor switch (12) may be a hall switch used in conjunction with a magnet (11), which is attached to the piston (5). It is understood that any sensing means which allows positional information of the piston (5) could be used for the sensor switch (12), including but not limited to: reed switches, optical sensors and mechanical limit switches. It is further desired to have a means of monitoring the rotation and or rotational velocity of the system. Such means could include voltage sensing on the motor (1) or a rotational sensor located preferably in a gear within the drive train (32). The sensor could allow the control circuit (3) to determine the piston (5) location by counting revolutions and processing the information as it relates to both speed and linear inch of travel per revolution of the motor (1). Additionally, the voltage sensing scheme could be used to monitor either the loaded or unloaded motor velocity and thus allow tuning the system for maximum energy extraction per cycle. A further use of such velocity information would be to limit the velocity of the motor (1) during the retraction of the piston (5), thus ensuring sufficient time for the rack (4) and piston (5) to return to the start position before engaging the rack pinion (41). Additional uses of such information could be to alter the speed of the piston (5) during the compression stroke or altering the timing of the release of the valve (7). After the air pressure has been released to the projectile (9) and the piston (5) has returned, a full cycle has been completed and the electric air gun is ready for initiation of another cycle. It should be noted while a rack and pinion assembly is described in this embodiment, substantially similar elements which convert rotational motion to linear motion (i.e. a linear motion converter) may be substituted. Such elements could include, but are not limited to, slider crank mechanisms, lead screw and nuts or gear and belt driven systems.

A bolt (6) is used in many air gun designs to chamber the projectile (9). It can be either manually operated or automatically operated. In the embodiment shown in FIGS. 1 and 2, the bolt (6) is coupled to the rack (4) thru a system of linkages and springs. These linkages and springs include an actuation limit spring (30), a bolt link (15) and a bolt return spring (20). Additionally, the air compressed by the piston (5) may travel thru the bolt (6) allowing for a more efficient and compact design. In the present design, the bolt coupling mechanism is referred to as a lost motion device. The purpose of this is to limit the motion of the bolt to a fraction of the piston (5) movement with the desired ratio being less then 80%. The actuation limit spring (30) which is inserted between the bolt link (15) and the bolt (6) limits the bolt (6) forces improving the safety profile against possible pinch points. For example, if the user were to depress the mechanism and insert their finger in the projectile inlet port (16), the force of the bolt (6) if directly coupled to the piston (5) could injure the operator. The bolt return spring (20) maintains a normally open bolt design, increasing the time available for the projectile (9) to fall into position. Depending on the design requirements, the springs (20, 30) could be biased in such a way as to result in open or closed bolt designs. Since many of these designs will employ gravity feeders, the open bolt design is useful as it allows extra time for the projectile (9) to fall into place during intermittent firing modes.

The present invention includes additional enhancements like end of stroke bumpers (17) shown in FIG. 1. These elements absorb excess kinetic energy at the ends of stroke and help minimize reactionary forces or prevent damage in the event of a malfunction. These bumpers are may be made from elastomeric materials including but not limited to urethanes, rubbers and neoprenes. They are designed to absorb impacts of at least 10 inch-lbs without damage.

In accordance with the present invention, it is beneficial to combine feeders with the operational characteristics of the electric air gun as described in patent application Ser. No. 10/764,793, the contents of which are hereby incorporated and included by reference.

Figure 5:
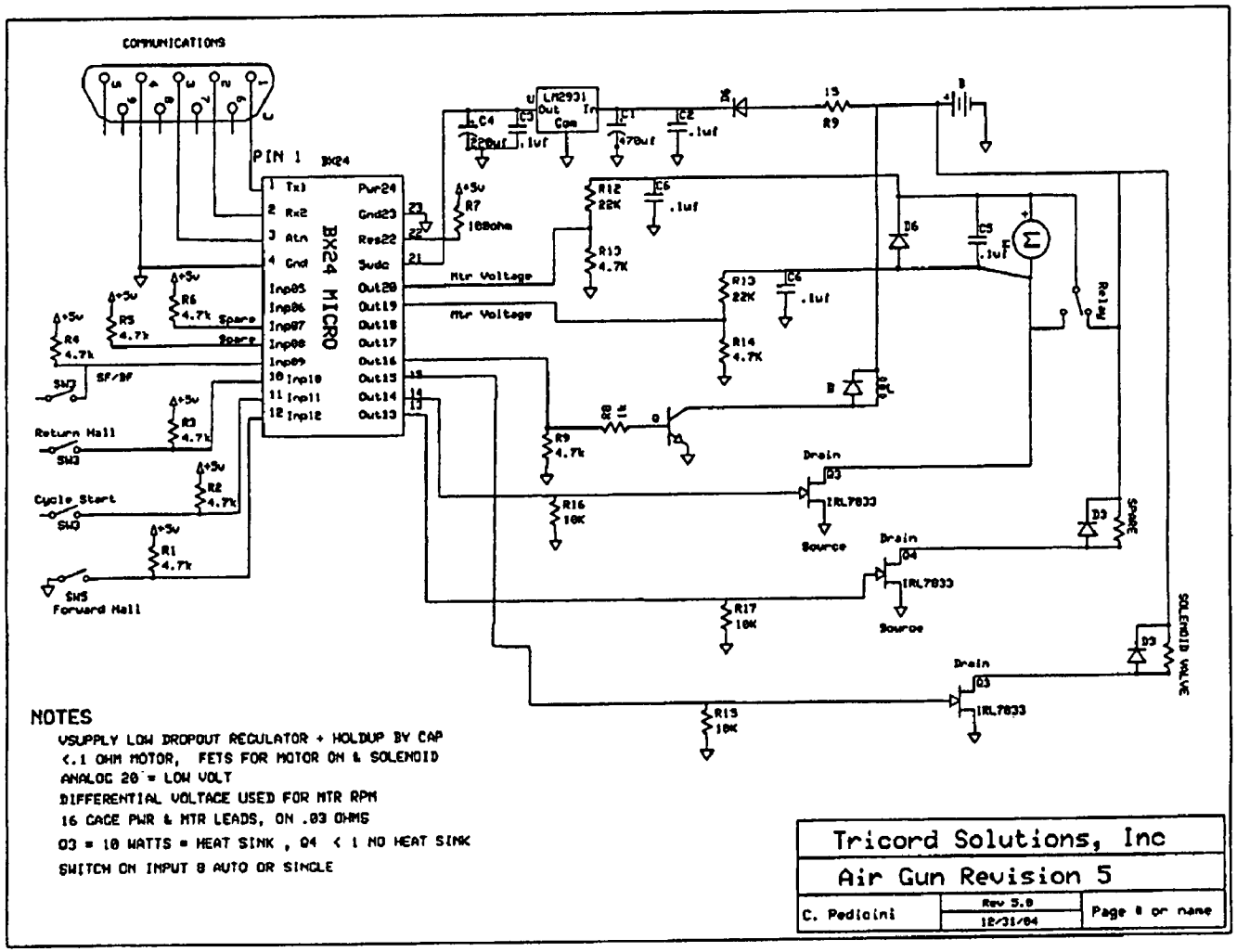
FIG. 5 is a schematic of a control circuit

Circuit Operation:

A schematic of the control circuit (3) is shown in FIG. 5. In the embodiment illustrated, the control circuit (3) includes a microprocessor, high power switching elements and at least one control circuit input. The control circuit input(s) can be internal or external timers or sensors. Looking additionally to FIG. 1, the gun uses a start switch (10), at least one sensor to detect position of the compression piston (5), a method of determining motor speed and FETs or relays to control power to the motor (1). Although these elements are used in the present design, it is understood by those familiar with the art that considerable simplification is possible without departing from the spirit of the invention. The cycle begins with the pressing of the start switch (10). Although the power can be directed to the motor (1) through the start switch (10), it is desirable to use Mosfets or Relays.

In order to maintain responsiveness of an electric air gun, it is desirable that the overall resistance from the power source (2) to the motor (1) be kept very low. A key design parameter is that the overall circuit resistance from the power source (2) to the motor (1) must be less then 0.02 ohms per applied volt from the power source (2). For very high performance electric air guns, a brushless motor has advantages of lower maintenance, high power density and good heat dissipation. The issue of heat dissipation is important to intermittent on demand electric air guns. A separate cooling fan may be needed to cool the switching elements and/or the motor depending on the duty cycle requirements. The cooling fan may be controlled in response to either a heat sensor such as a thermister or thermocouple placed within the body of the electric air gun. Additionally, the heat sensor could be used to limit the cycling of the unit should excessive temperatures be reached. It is further possible to control the cooling fan in response to a predetermined program stored within the microprocessor.

Once power is applied to the motor (1), the piston (5) begins to advance via the rotation of the rack pinion (41) driving the rack (4). The feedback elements are used to determine the location of the piston (5). The control circuit (3) can make decisions in regards to releasing the high-pressure air in the case of a solenoid or other electromotive retention of the valve (7). Additionally, sensor input can be useful in recovery from various jam conditions. At the end of a cycle, a further control circuit input such as another sensor, pressure transducer or a timer may be used to shut the power off from the motor (1) and thus leave the electric air gun ready for the next cycle.

A further enhancement of the control circuit (3) includes monitoring the start switch (10) depressions during a cycle. This allows the gun to continue cycling in a seamless fashion in the event the start switch (10) is actuated faster than the electrical projectile (9) launches can occur. For example, one or more additional trigger (42) pulls could be stored thus allowing the user the ability to fire sequential shots in a semiautomatic fashion without having to coordinate the shots with the finish of a cycle in the electric air gun. A further embodiment includes the ability to have a shot counter or battery monitor to warn the user when the battery is low. For example, with a power source (2) which is good for 300 shots, a warning light could be illuminated when less then 25 shots remain. Additionally, the voltage of the battery or the voltage applied to the motor (1) during the compression cycle may be monitored. This allows the microprocessor to adjust the duty cycle of the motor (1) thru either pulsing the motor (1) or pulse width modulation of the motor power to create uniform compression cycles even as the battery voltage decays, thus extending the number of shots per charge.

The sensor locations may include at least one position of the piston (5). In order to determine motor (1) velocity, it is desirable to monitor the voltage on the motor (1) during an unloaded condition. The difference between these voltages multiplied by the motor Kv (rpm/volt) constant can be used to approximate the motor speed. It is understood by those skilled in the art that the sensors can be used in conjunction with circuit elements to allow location at different places and that sensors can be of many forms including but not limited to limit switches, hall effect sensors, photosensors and reed switches without departing from the spirit of the invention.

A further improvement in the electric air gun includes routing at least a portion of the power through the start switch (10) to allow cycling only if the start switch (10) is depressed. To reduce contact wear, the control circuit (3) may introduce a delay such that the high power is switched after the start switch (10) is fully closed thus eliminating arcing.

Additional enhancements to the control circuit include provision for or providing a communication port or a display which communicates status conditions. Safety provisions include the microprocessor locking out the unit operation on certain fault conditions, integration of a password required for operation or the inclusion of a keyswitch required for operation.

Thus, although there have been described particular embodiments of the present invention of a new and useful PORTABLE ELECTRIC-DRIVEN COMPRESSED AIR GUN, it is not intended that such references be construed as limitations upon the scope of this invention except as set forth in the following claims.

We claim:

1. An electrically-driven compressed air gun used for firing a projectile, said gun comprising:

a power source;

a motor connected to said power source;

a sensor;

a control circuit configured for controlling the motor using information from the sensor;

a start switch configured to direct power from the power source to the motor by means of the control circuit;

a barrel including a projectile inlet port to receive the projectile;

a bolt operationally coupled to the barrel, the bolt configured to move between a first position and a second position and capable of chambering the projectile in the barrel when the bolt is moved from the first position to the second position and shutting off the projectile inlet port when the bolt is positioned at the first position;

a cylinder comprising a front end and a rear end;

a drive assembly comprising, a piston movable within the cylinder, wherein the piston defines a forward air chamber between the piston and the front end of the cylinder, the forward air chamber capable of accommodating air therein; and a rack and pinion assembly for coupling the piston to the motor for converting a rotational motion of the motor into a reciprocating motion of the piston; and a valve functionally disposed between the barrel and the cylinder, the valve configured to isolate the air in the forward air chamber from the barrel and further configured to release the air compressed in the forward air chamber through a compressed air passageway into the barrel to drive the projectile from the barrel, wherein the compressed air passageway is configured between the cylinder and the barrel by positioning the bolt at the first position; and wherein the piston moves from the rear end of the cylinder towards the front end of the cylinder and polytropically compressing the air in the forward air chamber with a compression exponent of at least 1.1.

2. The apparatus according to claim 1, wherein the means for coupling the piston to the motor includes a rack comprising a section wherein a portion of teeth is removed from the rack, the section capable of preventing the piston from contacting the front end of the cylinder.

3. The apparatus according to claim 1, wherein the circuit includes a separate cooling fan.

4. The apparatus according to claims 1, wherein the projectile is selected from the group consisting of a paintball, an airsoft ball, a "bb", and a pellet.

5. The apparatus according to claims 1, wherein the motor is capable of being powered on and off in response to signal from said sensor.

6. The apparatus according to claim 1, wherein the circuit contains a communication port for the exchange of data with an external device.

7. The apparatus according to claim 1, wherein the circuit includes an interface for displaying attributes.

8. An apparatus for launching a projectile comprising:

a power source;

a control circuit coupled to said power source;

a motor connected to said control circuit, said control circuit directing power from the power source to the motor;

a pinion connected to said motor;

a rack coupled with said pinion;

a piston coupled to said rack;

a cylinder having a front end and a rear end, said cylinder housing said piston and a movement of the piston defining a forward air chamber between the piston and the front end of the cylinder, wherein the forward air chamber is capable of accommodating air therein;

an air energy storage means active in one direction of piston movement in which rack and rack pinion are engaged;

a piston return spring active in a direction opposite the air energy storage means direction, wherein the piston return spring is configured to predispose the piston to a start position of the piston;

a barrel supporting the projectile; and a valve functionally disposed between the barrel and the cylinder, wherein the valve is configured to isolate the air in the forward air chamber from the barrel and wherein the valve is further configured to release the air compressed in the forward air chamber with a compression exponent of at least 1.1 into the barrel through a compressed air passageway, wherein said projectile is driven from the barrel due to compressed air being forced through compressed air passageway and expanding into said barrel.

9. The apparatus according to claim 8, wherein the piston return spring is selected from the group consisting of a mechanical spring, an air spring, an elastomeric element or a vacuum.

10. The apparatus according to claim 8, wherein the rack comprises a section wherein a portion of teeth is removed from the rack, the section capable of preventing the piston from contacting the front end of the cylinder in a direction of air energy storage.

11. The apparatus according to claim 8, wherein the control circuit directs power form the power source to the motor such that resistance between the motor and the power source is less then 0.02 ohms per applied volt while the piston is moving in the direction of air energy storage means.

12. The apparatus according to claim 8, wherein the circuit includes a first sensor and a second sensor said first sensor detects a position of said pinion and said second sensor detects a position of said rack.

13. An apparatus for launching a projectile comprising:

a power source;

a control circuit coupled to said power source;

a motor;

means for coupling said control circuit to said motor for the purpose of directing power from the power source to the motor;

a linear motion converter;

means for coupling said motor to said linear motion converter;

a barrel comprising a projectile inlet port to receive the projectile;

a piston;

means for coupling said piston to said linear motion converter;

a cylinder comprising a front end and a rear end, wherein the piston reciprocates within said cylinder;

a plurality of sensors comprising a heat sensor, a piston location sensor and a motor speed sensor, the heat sensor configured to detect and limit the temperature inside the apparatus, the piston location sensor configured to detect position of the piston and the motor speed sensor configured to detect speed of the motor;

a bolt that shuts off said projectile inlet port;

lost motion means for coupling said bolt to said reciprocating linear motion converter;

a valve;

a forward air chamber defined by said piston, said valve and said cylinder, wherein air in said forward air chamber is isolated from said projectile by said valve; and means for controlling the valve in order to direct air, that is compressed by the piston, from the cylinder to the barrel, wherein said projectile is released from the barrel due to compressed air being forced from the cylinder to the barrel.

14. The apparatus according to claims 13, wherein the control circuit routes power through a start switch and wherein said start switch is closed prior to power being applied to said motor.

15. The apparatus according to claim 13, wherein the control circuit controls the speed of the motor in response to the sensors.

16. The apparatus according to claim 13, wherein the lost motion means coupled to the bolt includes at least one spring capable of limiting the movement of the bolt to less then about 50% of the movement of the linear motion converter.

17. The apparatus according to claim 13, wherein the control circuit includes a heat sensor responsive to temperature of said gun and wherein said sensor can limit the rate of fire depending on the temperature.

* * * * *